US007571620B2

(12) United States Patent
Lee et al.

(10) Patent No.: US 7,571,620 B2
(45) Date of Patent: Aug. 11, 2009

(54) AIR CONDITIONER

(75) Inventors: Sang Hun Lee, Gimhae-si (KR); In Hee Park, Changwon-si (KR)

(73) Assignee: LG Electronics Inc., Seoul (KR)

( * ) Notice: Subject to any disclaimer, the term of this patent is extended or adjusted under 35 U.S.C. 154(b) by 597 days.

(21) Appl. No.: 11/148,387

(22) Filed: Jun. 9, 2005

(65) Prior Publication Data

US 2005/0284170 A1 Dec. 29, 2005

(30) Foreign Application Priority Data

Jun. 11, 2004 (KR) ..... 10-2004-0042818

(51) Int. Cl.
*F25D 17/06* (2006.01)

(52) U.S. Cl. ..... 62/426; 415/53.1; 415/143; 416/175

(58) Field of Classification Search ..... 62/82, 62/256, 404, 407, 419, 426; 415/53.1, 143; 416/175
See application file for complete search history.

(56) References Cited

U.S. PATENT DOCUMENTS 3,364,989 A * 1/1968 Kenneth ..... 165/122
4,686,680 A * 8/1987 Hoag et al. ..... 372/58
6,560,968 B2 * 5/2003 Ko ..... 62/3.2

FOREIGN PATENT DOCUMENTS

| | | | |
|---|---|---|---|
| EP | 0 483 977 | A1 | 5/1992 |
| GB | 1283281 | | 7/1972 |
| JP | 59-134439 | A | 8/1984 |
| JP | 6-147531 | A | 5/1994 |
| JP | 2004156880 | A * | 6/2004 |

OTHER PUBLICATIONS

Translation Of 2004-156880, Jun. 6, 2004.*
Foreign office action for Chinese Patent Application No. 200510087847.9.

* cited by examiner

*Primary Examiner*—William E Tapolcai
(74) *Attorney, Agent, or Firm*—Birch, Stewart, Kolasch & Birch, LLP

(57) ABSTRACT

An indoor unit of an air conditioner capable of enhancing heat exchange efficiency and reducing noise/vibration is provided. The indoor unit includes a main chassis, a front panel, a cross-flow fan, a fan motor, a heat exchanger, and a discharge port. The main chassis has a backside fixed on a place to be installed. The front panel is formed on the front of the main chassis and has a spacer formed in an inside thereof. The cross-flow fan is disposed in the inside of the space and provided in plurals on the same shaft. The fan motor provides rotational power to the cross-flow fan. The heat exchanger is formed on the front of the cross-flow fan with respect to the flowing direction of air. The discharge port guides discharge of the air blown from the cross-flow fan.

18 Claims, 4 Drawing Sheets

AIR CONDITIONER

BACKGROUND OF THE INVENTION

1. Field of the Invention

The present invention relates to an air conditioner, and more particularly, to an indoor unit of an air conditioner having heat exchangers and fans, each having corresponding size and quality. The present invention relates to an indoor unit of an air conditioner having fans installed symmetrically and capable of reducing vibration and enhancing heat exchange efficiency during operation.

2. Description of the Related Art

An air conditioner is a device for maintaining optimized inside air according to purpose. For example, in the case where inside air becomes high temperature in summer, the air conditioner blows wind of low temperature to cool down the inside. On the contrary, in winter, the air conditioner blows warm wind of high temperature to heat the inside air.

The air conditioners are roughly divided into an integral type and a separation type. An integral type air conditioner has one unit as a whole and a separation type air conditioner separately has an indoor unit installed inside a space that needs air-conditioning and an outdoor unit installed in the outside. Particularly, recently, a separation type air conditioner is widely used considering noise and installation environment of an air conditioner.

FIG. 1 is an exploded perspective view of a separation type air conditioner of a related art and FIG. 2 is a view illustrating air is sucked into and discharged from an indoor unit of a separation type air conditioner of a related art.

Referring to the drawings, a main chassis 1 forms a frame of an indoor unit. The main chassis 1 has a front panel 3 formed on a front side thereof to form the outer appearance of the indoor unit. The main chassis 1 having the front panel 3 is mounted on a wall in the inside.

A space in which parts that will be described below are mounted is formed between the main chassis 1 and the front panel 3.

In the meantime, the outer appearance of the indoor unit formed by the main chassis 1 and the front panel 3 is protruded toward the front side as a whole as illustrated in FIG. 1.

A suction panel 7 having a front suction grill 5 is provided on the front of the front panel 3 to form a front appearance of the indoor unit. A hinge member (not shown) is provided at the upper end of the suction panel 7 to allow the suction panel 7 to rotate.

The front suction grill 5 is a path through which air sucked from a space that needs air-conditioning is sucked into the inside of the indoor unit. The front suction grill 5 is integrally formed with the suction panel 7. In the meantime, an upper suction grill 3' is formed long left and right on the upper side of the front panel 3. The upper suction grill 3' is integrally formed with the front panel 3 or separately formed.

A heat exchanger 9 is installed at the back of the front panel 3. The heat exchanger 9 allows air sucked through the front suction grill 5 and the upper suction grill 3' to exchange heat while passing through the exchanger 9. A filter 9' for purifying sucked air is installed on the front of the heat exchanger 9.

A cross-flow fan 10 is installed at the back of the heat exchanger. The cross-flow fan 10 sucks air from a space that needs air-conditioning and discharges air back to the space that needs air-conditioning. A fan motor 10' for providing rotational power to the cross-flow fan 10 is installed on the right side of the cross-flow fan 10 and a member for guiding flow created by the cross-flow fan 10 is further integrally formed in the inside of the main chassis 1.

In the meantime, air that has heat-exchanged while passing through the heat exchanger 9 is discharged to a space that needs air-conditioning through the cross-flow fan 10. For that purpose, a discharge grill 11 is installed at the lower end of the main chassis 1 and the front panel 3.

In the meantime, a discharge port 13 for guiding air that has passed through the cross-flow fan 10 to a space that needs air-conditioning is formed in the inside of a discharge grill 11.

A vane 15 for vertically controlling the direction of discharged air and a louver for horizontally controlling the direction of discharged air are installed in the inside of the discharge port 13. The louver 16 is provided in plurals and the louvers 16 are connected to each other by a link 17 to operate simultaneously.

Also, a display part 19 for displaying an operation state of an air conditioner is provided at an about center on the lower portion of the front panel 3.

Description will be made for the air conditioner having the above-described construction and operating in a cooling mode.

When the air conditioner operates, air for air-conditioning is sucked into the inside of an indoor unit by the cross-flow fan 11. That is, air is sucked into the inside of the indoor unit through the front suction grill 5 and the upper suction grill 3' to pass through the heat exchanger 9.

The air that has passed through the heat exchanger 9 exchanges heat with working fluid flowing in the inside of the heat exchanger 9.

The air that has exchanged heat with the heat exchanger 9 becomes relatively low temperature and is sucked into the cross-flow fan 10. The air sucked into the cross-flow fan 10 is discharged to the lower direction and guided to the side of the discharge port 13.

The air guided to the inside of the discharge port 13 changes a discharging direction thereof using the vane 15 and the louver 16 installed inside the discharge port 13 and is discharged to a space that needs air-conditioning through the discharge grill 13. At this point, since the vane 15 and the louver 16 allow the discharged air to be distributed vertically and horizontally, the air is uniformly discharged to the space that needs air-conditioning.

To fix the heat exchanger 9, a fixing bracket 8 is provided to the left of the main chassis 1 and a fixing end 8' that corresponds to a screw-coupling end 9*a* of the heat exchanger 9 is provided to the right of the main chassis 1. A screw-coupling hole 8" should be punched in the inside of the fixing end 8'.

A receiving groove 8a for receiving a left end of the heat exchanger 9 is formed on the front side and the upper side of the fixing bracket 8. Hookers 8*b* for hooking and fixing a left hairpin 9*c* of the heat exchanger 9 are protruded in the inside of the receiving groove 8*a*.

A screw through hole 9*b* that corresponds to the screw-coupling hole 8" is punched in the inside of the screw-coupling end 9*a* of the heat exchanger 9.

The heat exchanger 9 is fixed by fixing the fixing bracket 8 in the left of the main chassis 1 using a screw S. At this point, the receiving groove 8*a* of the fixing bracket 8 is open toward the right side.

When the hairpin 9*c* of the heat exchanger 9 is inserted into the receiving groove 8*a* of the fixing bracket 8, the hairpin 9*c* is hooked at and fixed in the hooker 8*b* of the inside of the receiving groove 8*a*. At this point, the left end of the heat exchanger 9 is fixed first.

After that, the right side of the heat exchanger 9, more specifically, the screw-coupling end 9*a* is closely attached to the fixing end 8' of the main chassis 1 and the screen through hole 9*b* is coupled to the screw-coupling hole 8" using a screw S, so that the heat exchanger 9 is fixed to the main chassis 1.

However, the related art has the following problems.

Indoor unit of the air conditioner of the related art has one cross-flow fan 10 and one fan motor 10', so that air is discharged in one direction by the cross-flow fan 10. Accordingly, the related art air conditioner cannot discharge air to various directions.

Also, since the fan motor 10' is provided to one side of the cross-flow fan 10 and connected with the cross-flow fan 10 by the same shaft, horizontal balance of the cross-flow fan 10 is difficult to maintain. Therefore, fine vibration and noise might occur when the cross-flow fan 10 rotates.

SUMMARY OF THE INVENTION

Accordingly, the present invention is directed to an indoor unit of an air conditioner that substantially obviates one or more problems due to limitations and disadvantages of the related art.

An object of the present invention is to provide an indoor unit of an air conditioner capable of air-conditioning an inside space on the whole by having air discharged to various directions.

Another object of the present invention is to provide an indoor unit of an air conditioner capable of reducing noise while the indoor unit operates by providing exchangers and fans having corresponding qualities and sizes.

A further another object of the present invention is to provide an indoor unit of an air conditioner capable of operating fans using a single fan motor by installing the fan motor in a space between the fans.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided an indoor unit of an air conditioner including: a main chassis having a backside fixed on a place to be installed; a front panel formed on a front side of the main chassis and having a space formed in an inside thereof; a cross-flow fan disposed in an inside of the space and provided in plurals on the same shaft; a fan motor for providing rotational power to the cross-flow fan; a heat exchanger formed on a front side of the cross-flow fan with respect to a flowing direction of air; and a discharge port for guiding air blown from the cross-flow fan.

In another aspect of the present invention, there is provided an indoor unit of an air conditioner including: cross-flow fans spaced apart from each other; a fan motor for providing rotational power to the cross-flow fans; heat exchangers spaced apart from each other and each being installed on one side of each of the cross-flow fans, and where heat exchange occurs; and an discharge port for guiding air discharged from the cross-flow fan.

In a further another aspect of the present invention, there is provided an indoor unit of an air conditioner including: a main chassis; a front panel formed on a front side of the main chassis and having a space formed in an inside thereof; cross-flow fans disposed in an inside of the space; a fan motor for providing rotational power to the cross-flow fans; a heat exchanger formed on a front side of the cross-flow fans with respect to a flowing direction of air; and a discharge port for guiding downward discharge of air blown from the cross-flow fans.

According to the separation type air conditioner of the present invention, heat exchange efficiency improves, vibration and noise occurring during operation of the indoor unit reduces, and the inner space of the indoor unit is efficiently arranged, so that the size of the indoor unit reduces.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
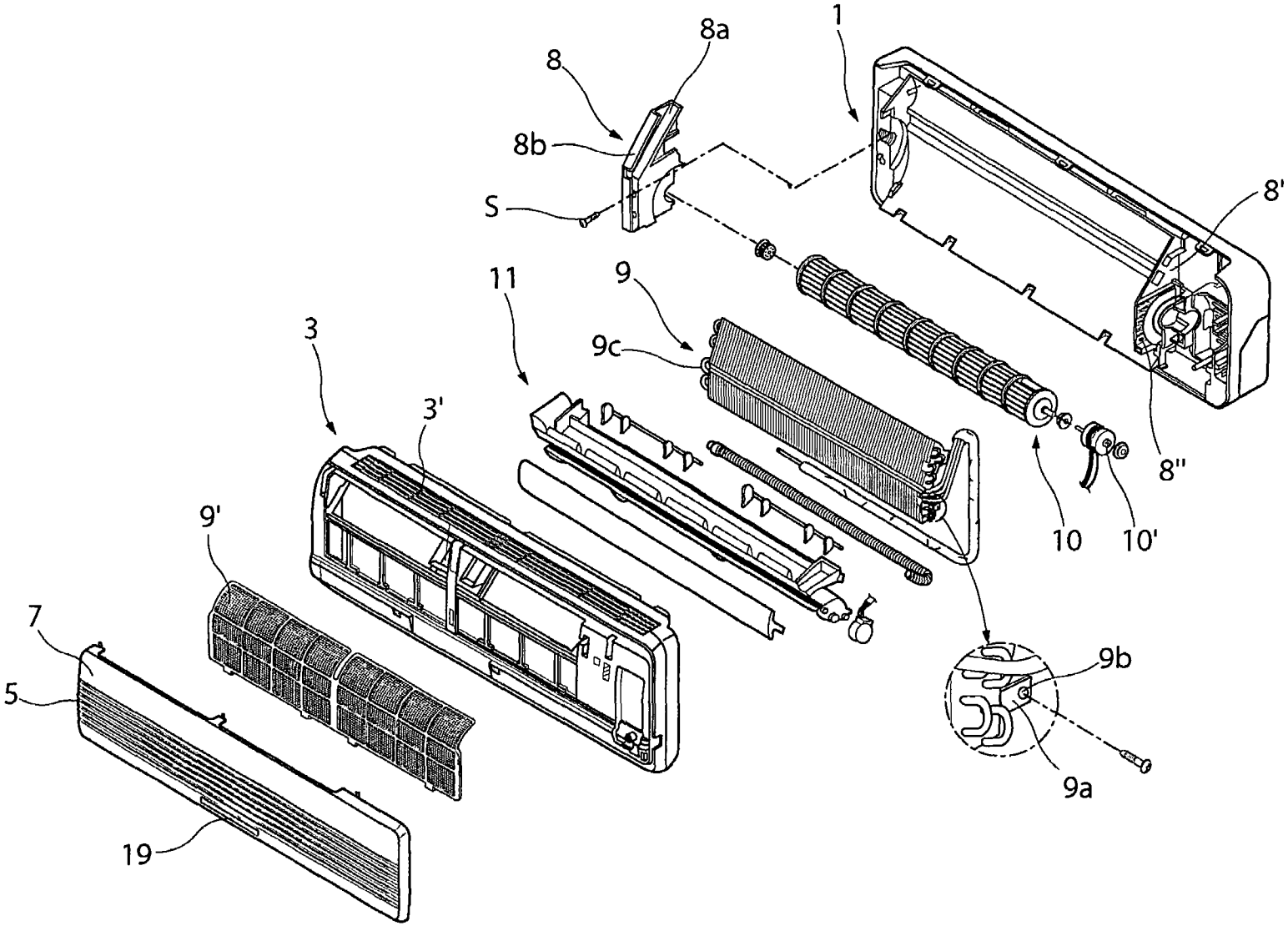
FIG.1(Related art)
FIG. 1 is an exploded perspective view of an indoor unit of an air conditioner of a related art.
Figure 2:
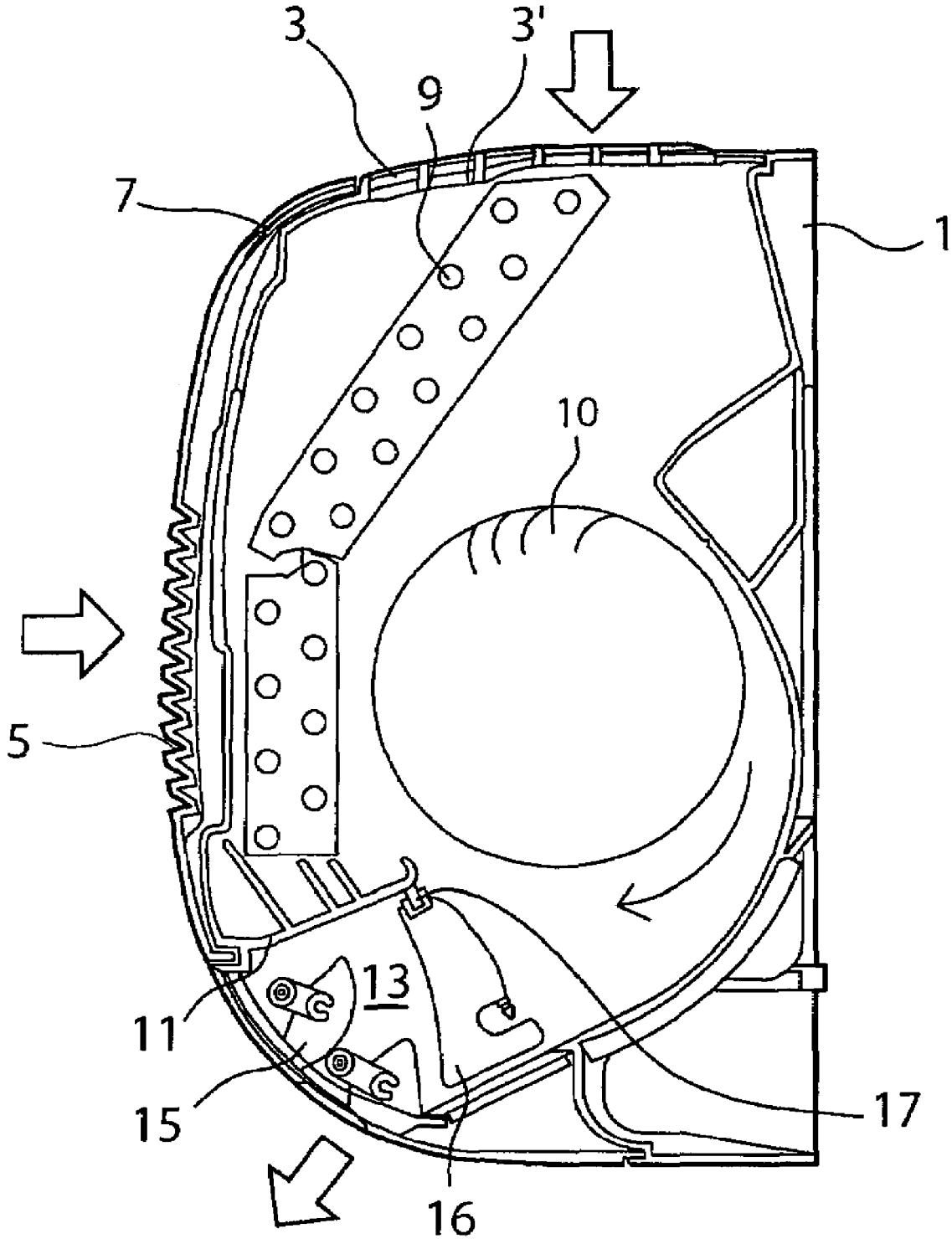
FIG.2(Related art)
FIG. 2 is a side view illustrating an air flow in an indoor unit of an air conditioner of a related art.
Figure 3:
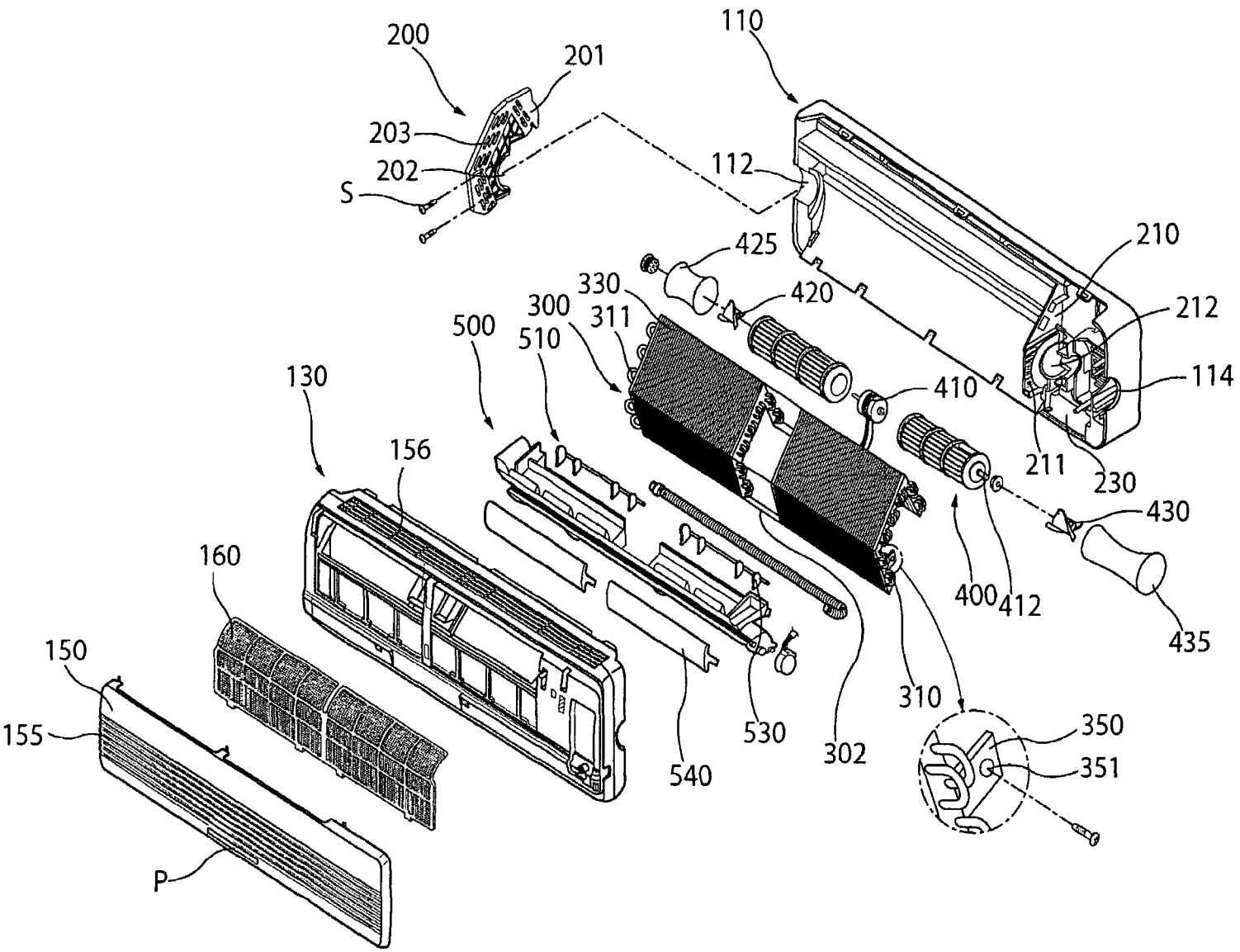
FIG. 3 is an exploded perspective view of an indoor unit of an air conditioner of the present invention.

FIG. 3 is an exploded perspective view of an indoor unit of an air conditioner of the present invention.

Referring to FIG. 3, the indoor unit of the air conditioner includes a main chassis 110 and a front panel 130, which constitute an appearance.

The main chassis 110 serves as a basic element of the indoor unit of the air conditioner, has a quadrangular space subsiding in a front side thereof, and has a backside fixed on an inside, i.e., a wall surface of a space that needs air-conditioning. A left discharge hole 112 for guiding air discharged by a left discharge fan 420 that will be described later is formed on the left side of the main chassis 110 and a right discharge hole 114 for guiding air discharged by a right discharge fan 430 that will be descried later is formed on the right side of the main chassis 110.

Parts such as a heat exchanger and a cross-flow fan that will be described later are installed between the main chassis 110 and the front panel 130. In the meantime, the appearance of the indoor unit formed by the main chassis 110 and the front panel 130 is protruded to round on the whole toward the front side as illustrated.

A suction panel 150 having a front suction grill 155 is installed on the front of the front panel 130. The front suction grill 155 is a path through which air sucked from a space that needs air-conditioning is sucked into the inside of the indoor unit. For that purpose, the front suction grill 155 passes through the suction panel 150. Also, an upper suction grill 156 is formed on the upper side of the front panel 130 to allow air of the upper portion of the space that needs air-conditioning to be sucked into the inside of the indoor unit. A filter 160 is provided between the front panel 130 and the suction panel 150. The filter 160 filters air sucked through the front suction grill 155.

A heat exchanger holder 200 for fixing the left of the heat exchanger to the main chassis 110 is fixed at the left end of the inside of the main chassis 110 by a screw. A right holder 210 in which the right of the heat exchanger is fixed is protruded on the right of the inside of the main chassis 110.

In detail, the heat exchanger holder 200 includes a frame part 201 to which the left end of the heat exchanger is closely attached and a hairpin guide 203 punched in an edge of the frame part 201. The size and the number of the hairpin guides 203 correspond to a hairpin of the heat exchanger that will be described later.

The frame part 201 serves as a basic element forming the heat exchanger holder 200 and has a predetermined thickness. The reason the frame part 201 is formed to have a predetermined thickness is that the frame part 201 should substantially support the weight of the heat exchanger.

A hairpin guide 203 is punched in the frame part 201. The hairpin guide 203 is a kind of through hole for receiving a fixing the hairpin of the heat exchanger and formed along the outer edge of the frame part 201. The hairpin guide 203 corresponds to the hairpin of the heat exchanger. Therefore, when the heat exchanger has one step or two-step bending shape, the hairpin guides 203 have an about "ㄷ" shape.

The heat exchanger holder 200 may be fixed to the main chassis 100 through a screw S as a separate member or may be integrally formed with the main chassis 100. A left guide hole 202 through which air discharged by the left discharge fan 420 passes is formed on the rear end of the heat exchanger holder 200.

The right holder 210 is intended for fixing the right end of the heat exchanger. A coupling hole 211 that corresponds to a through hole of the fixing end of the heat exchanger is punched in one side of the right holder 210. Also, a right guide hole 212 through which air guided by the right discharge fan 430 on the right is formed in a passing through manner on the center of the right holder 210.

A control box seat part 230 on which a control box is installed is formed between the right holder 210 and the right end of the main chassis 100.

In the meantime, the heat exchanger 300 is installed at the rear side of the front panel 130, more specifically, in a space formed between the main chassis 110 and the front panel 130. The heat exchanger 300 includes two heat exchangers spaced apart on left and right and coupled to each other by connection guides 302.

The heat exchanger 300 allows air to exchange heat while the air sucked through the front suction grill 155 and the upper suction grill 156 passes therethrough and includes coolant tubes 310 and cooling pins 330.

The coolant tube 310 is a path through which working fluid flowing through a heat exchange cycle, namely, a coolant flows and has the cooling pins 330 fitted therein with a predetermined interval. With such a construction, the coolant flowing through the coolant tube 310 cools down the cooling pin 330. Therefore, the air sucked through the front suction grill 155 and the upper suction grill 156 is cooled down while passing through the cooling pin 330.

In the meantime, the coolant tube 310 runs between left and right of the heat exchanger several times and has an about 'U'-shaped hairpin 311 formed on the end thereof, i.e., the portion returning back to the opposite side. The hairpins 311 are protruded on both sides as the coolant tube 310 runs between left and right several times and inserted into the hairpin guide 203 of the heat exchanger holder 200.

A cross-flow fan 400 is installed in the rear of the heat exchanger 300, more specifically, between the heat exchanger 300 and the main chassis 100.

The cross-flow fan 400 sucks air for air-conditioning and discharges the air downward. That is, the cross-flow fan 400 discharges the heat-exchanged air to the lower direction perpendicular to the rotational axis of the cross-flow fan 400. Generally, the cross-flow fan has straight-line type wings. That is, since the cross-flow fan has wings bent in the rotational direction, a suction/discharge flow to an axial direction is not generated but suction/discharge flow is generated within a plane perpendicular to the axis of the cross-flow fan.

Also, the cross-flow fan 400 is formed in a pair to correspond to the heat exchanger 300. That is, the cross-flow fan 400 is installed on left and right, respectively. The horizontal width of the cross-flow fan 400 may have a length that corresponds to the horizontal width of the heat exchanger 300.

The reason the cross-flow fan 400 has the length that corresponds to the horizontal width of the heat exchanger 300 and is installed in the corresponding position is to improve heat exchange efficiency by increasing a ratio that the air flowed (sucked) by the cross-flow fan 400 passes through the heat exchanger 300.

A fan motor 410 is installed between the pair of cross-flow fans 400 to deliver rotational power to the cross-flow fan 400, a left discharge fan 420, and a right discharge fan 430. That is, the fan motor 410 has a rotational shaft 412 extending long horizontally. The rotational shaft 412 delivers the rotational power of the fan motor 410 to the cross-flow fan 400, the left discharge fan 420, and the right discharge fan 430.

The left discharge fan 420 for guiding sucked air to the left is disposed on the left of the cross-flow fan 400. The left discharge fan 420 may include a chi-fan and is installed on the same axis line as the cross-flow fan 400 to discharge air to the axial direction.

The left fan housing 425 is installed on the outer side of the left discharge fan 420. The left fan housing 425 guides the air forcibly blown by the left discharge fan 420 and has a discharge guide hole (not shown) formed therein horizontally in a passing through manner. The discharge guide hole may have a size that corresponds to the outer diameter of the rotational wing 424 of the left discharge fan 420. The left fan housing 425 has a cylindrical shape and a center whose diameter is relatively small compared with both side ends. That is, the diameter of the center has a diameter relatively smaller than that of both side ends and is rounded inward.

The right discharge fan 430 is further installed on the right of the fan motor 410. Therefore, the air forcibly discharged by the right discharge fan 430 is discharged to the right. The right discharge fan 430 is installed on the same axis line as the cross-flow fan 400 and may have the same shape as the left discharge fan 420. A right fan housing 435 is installed on the outer side of the right discharge fan 430. The right fan housing 435 has the same shape as the left fan housing 425 to guide the air forcibly blown by the right discharge fan 430 to the right.

In the meantime, the air that has exchanged heat while passing through the heat exchanger 300 is discharged to a space for air-conditioning by the cross-flow fan 400. For that purpose, a discharge grill 500 is installed at the lower end of the main chassis 110.

A discharge port 510 for guiding the air that has passed through the cross-flow fan 400 to the space for air-conditioning is formed in the inside of the discharge grill 500. The discharge port 510 is formed in plurals to correspond to the cross-flow fans 400. That is, a pair of discharge ports 510 is formed at the lower side of the pair of cross-flow fans 400 to guide the air discharged by the cross-flow fans 400, respectively.

A louver 530 for controlling horizontal flow of the discharged air is provided to the inside of the pair of the discharge ports 510. Also, the discharge port 510 is selectively opened/closed by a discharge vane 540. Accordingly, like the discharge port 510, the discharge vane 540 is provided in plurals to open/close each of the discharge ports 510.

Also, a display part P for displaying an operation status of the air conditioner is provided on an about center at the lower end of the suction panel 150.

Operation of the indoor unit of the air conditioner having the above construction will be described with reference to FIGS. 3 to 5.

Figure 4:
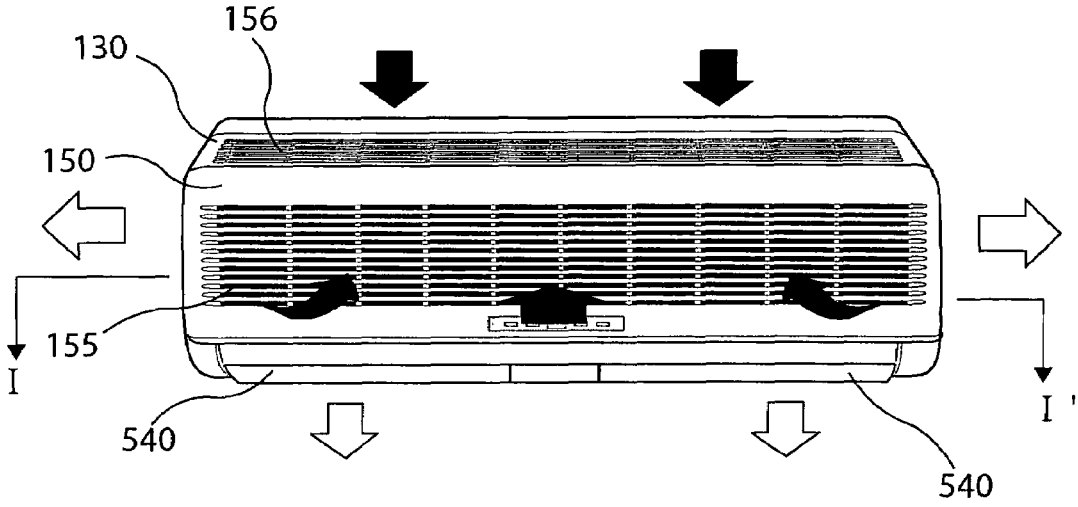
FIG. 4 is a front view illustrating an air flow in an indoor unit of an air conditioner of the present invention.
Figure 5:
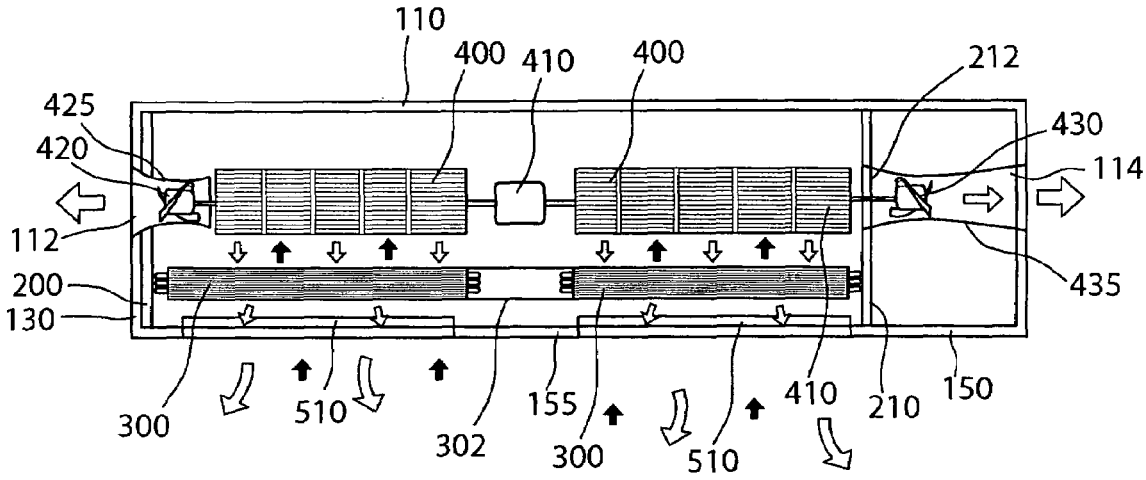
FIG. 5 is a sectional view taken along a line I-I' of FIG. 4, illustrating an air flow in the inside of an indoor unit of an air conditioner of the present invention.

FIG. 4 is a front view of an indoor unit of an air conditioner of the present invention, in which a sold arrow illustrates the suction direction of air and an arrow having a vacant inside illustrates the discharge direction of air.

When the air conditioner operates by power applied from the outside, the fan motor 410 operates to create rotational power. The rotational power of the fan motor 410 is delivered to the pair of cross-flow fans 400, the left discharge fan 420, and the right discharge fan 430 through the rotational shaft 412.

When the pair of the cross-flow fans 400 and the left and right discharge fans 420 and 430 rotate, air flow occurs in the inside of the indoor unit of the air conditioner to suck air from the outside. That is, the outside air is sucked through the front suction grill 155 and the upper suction grill 156 to pass through the pair of heat exchangers 300, during which heat exchange is performed.

The air cooled down while passing through the heat exchanger 300 is guided to the lower and both sides by the cross-flow fans 400, the left discharge fan 420, and the right discharge fan 430. That is, the air guided by the cross-flow fans 400 is discharged to the lower through the discharge ports 510 formed on the lower end of the main chassis 110 and the air guided by the left discharge fan 420 is discharged to the left of the indoor unit through the left discharge hole 112. Also, the air guided by the right discharge fan 430 is discharged to the right of the indoor unit through the right discharge hole 114.

In detail, the air sucked through the front suction grill 155 and the upper suction grill 156 and cooled by the heat exchangers 300 is discharged to the lower and sides of the indoor unit, respectively. That is, part of the sucked air is discharged to the lower by the cross-flow fan 400 and part of the sucked air is discharged to left and right sides of the indoor unit by the left and right discharge fans 430, respectively.

The air forcibly blown by the left and right discharge fans 420 and 430 is guided to the left and the right by the left and right fan housings 425 and 435, respectively.

The present invention is mainly directed to the indoor unit of the separation type air conditioner where the indoor unit and the outdoor unit are separated but not limited to that type air conditioner and can be easily modified to an indoor unit of the integral type air conditioner.

Also, to meet the requirement that the cross-flow fans 400 are operated by a single fan motor 410 without vibration and noise, the heat exchanger 300 may not be provided in plurals but a single heat exchanger 300 may be provided.

Also, in the above embodiment, the heat exchanger 300, the cross-flow fan 400, the discharge port 510, and the discharge vane 540 are provided in plurals to vertically correspond to the relevant element. The number of the elements is not limited to two as illustrated, more than two can be provided. With such a construction, heat exchange efficiency can be enhanced.

Also, in the above embodiment, all of the cross-flow fan 400, the left discharge fan 420, and the right discharge fan 430 are rotated by one single fan motor 410, the left discharge fan 420, and the right discharge fan 430 can be rotated by a separate motor.

According to the inventive indoor unit of the air conditioner, the heat exchangers are installed, the cross-flow fans are installed at the positions that correspond to the heat exchangers, and the fan motor is installed between the cross-flow fans. Also, the discharge vanes are formed at the positions that correspond to the cross-flow fans. Since the fan motor is installed at the center, horizontal balance is maintained on the whole, so that noise due to vibration reduces. Here, the noise reduction effect can be enhanced even more by providing the same-sized cross-flow fans.

Also, since sucked air passes through the heat exchanger to circulate through the cross-flow fans and the discharge vanes, the performance of the air conditioner improves. That is, the heat exchanger is not provided to the center where the fan motor is installed and the heat exchangers and the cross-flow fans are at the corresponding positions, so that heat exchange efficiency is optimized.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An indoor unit of an air conditioner comprising:

a main chassis;

a front panel formed on a front side of the main chassis and provided with at least one suction part through which passes indoor air, the main chassis and the front panel forming an inner space;

a cross-flow fan disposed in the inner space to suck the indoor air through the suction part and rotated about a rotational shaft;

a side discharge fan located on a lateral outer side of the cross-flow fan to suck the indoor air through the suction part and rotated about the rotational shaft, the side discharging fan blowing air in a direction parallel to the rotational shaft;

a fan motor for providing rotational power to the cross-flow fan and the side discharge fan;

a heat exchanger located on a front side of the cross-flow fan; and a discharge port for guiding air blown from the cross-flow fan.

2. The indoor unit according to claim 1, wherein the cross-flow fan includes a plurality of sub cross-flow fans with a same size.

3. The indoor unit according to claim 1, wherein the heat exchanger includes a plurality of sub heat exchangers corresponding to the sub cross-flow fans.

4. The indoor unit according to claim 1, wherein a length of the cross-flow fan is the same as a length of the heat exchanger.

5. The indoor unit according to claim 1, wherein the fan motor is the only motor to provide the rotational power to the cross-flow fan and the side discharging fan.

6. The indoor unit according to claim 1, wherein the cross-flow fan includes two sub cross-flow fans and the fan motor is located between the two sub cross-flow fans.

7. The indoor unit according to claim 1, wherein the discharge port includes a plurality of sub discharge ports spaced apart from each other.

8. The indoor unit according to claim 1, wherein the cross-flow fan discharges air in a direction perpendicular to the rotational shaft.

9. The indoor unit according to claim 1, wherein the main chassis has an opening at a lateral side of the main chassis, the opening at the lateral side of the main chassis facing in the direction parallel to the rotational shaft so that the air blown by the side discharging fan is discharged through the opening.

10. An indoor unit of an air conditioner comprising:

a plurality of cross-flow fans configured to suck in room air, the cross-flow fans being spaced apart from each other and rotated about a rotational shaft to blow air in one direction;

a side discharge fan configured to suck in the room air, the side discharge fan being located on a lateral outer side of one of the cross-flow fans and rotated about the rotational shaft, the side discharging fan blowing air in another direction parallel to the rotational shaft;

a fan motor for providing rotational power to the cross-flow fans;

a plurality of heat exchangers spaced apart from each other and each being installed on one side of a corresponding one of the cross-flow fans; and a discharge port for guiding air discharged from the cross-flow fans.

11. The indoor unit according to claim 10, wherein the fan motor is installed between the cross-flow fans.

12. The indoor unit according to claim 10, wherein the heat exchangers and the cross-flow fans correspond to each other and have widths corresponding to each other.

13. The indoor unit according to claim 10, wherein the discharge port includes a plurality of sub discharge ports corresponding to a same number of the cross-flow fans.

14. The indoor unit according to claim 10, further comprising a main chassis with an opening at a lateral side of the main chassis, the opening at the lateral side of the main chassis facing in the direction parallel to the rotational shaft so that the air blown by the side discharging fan is discharged through the opening.

15. An indoor unit of an air conditioner comprising:

a main chassis;

a front panel formed on a front side of the main chassis, and provided with at least one suction part through which passes indoor air, the main chassis and the front panel forming an inner space;

a plurality of cross-flow fans disposed in the inner space to suck the indoor air through the suction part and rotated about a rotational shaft;

a side discharge fan located on a lateral outer side of one of the cross-flow fans to suck the indoor air through the suction part and rotated about the rotational shaft, the side discharging fan blowing air in a direction parallel to the rotational shaft;

a single fan motor for providing rotational power to the cross-flow fans and the side discharge fan;

a heat exchanger located on a front side of the cross-flow fans; and a discharge port for guiding air blown from the cross-flow fans.

16. The indoor unit according to claim 15, wherein the cross-flow fans have a same size.

17. The indoor unit according to claim 15, wherein the heat exchanger is not provided to a portion where the single fan motor is installed.

18. The indoor unit according to claim 15, wherein the main chassis has an opening at a lateral side of the main chassis, the opening at the lateral side of the main chassis facing in the direction parallel to the rotational shaft so that the air blown by the side discharging fan is discharged through the opening.

* * * * *